US007287882B2

(12) United States Patent
Tsai

(10) Patent No.: US 7,287,882 B2
(45) Date of Patent: Oct. 30, 2007

(54) SHINING LOCK STRUCTURE

(75) Inventor: Cheng-Tao Tsai, Tainan (TW)

(73) Assignee: Jaeyou Co., Ltd., Tainan County (TW)

( * ) Notice: Subject to any disclaimer, the term of this patent is extended or adjusted under 35 U.S.C. 154(b) by 113 days.

(21) Appl. No.: 11/252,550

(22) Filed: Oct. 19, 2005

(65) Prior Publication Data

US 2007/0086178 A1 Apr. 19, 2007

(51) Int. Cl.
*F21V 21/00* (2006.01)

(52) U.S. Cl. ..... 362/374; 362/23; 362/375; 70/446; 70/454

(58) Field of Classification Search ..... 362/23, 362/208, 205, 374, 375; 70/432, 434, 446, 70/453, 454, 423
See application file for complete search history.

(56) References Cited

U.S. PATENT DOCUMENTS 3,256,428 A * 6/1966 Schwartz ..... 362/196
5,803,582 A * 9/1998 Huang ..... 362/109
5,893,631 A * 4/1999 Padden ..... 362/201
5,996,383 A * 12/1999 Adelmeyer et al. ..... 70/454
6,626,019 B1 * 9/2003 Huang ..... 70/456 R
6,863,416 B2 * 3/2005 Waters ..... 362/105
7,121,679 B2 * 10/2006 Fujimoto ..... 362/186
7,172,309 B2 * 2/2007 Parsons ..... 362/196
2002/0131264 A1 * 9/2002 Weisbach et al. ..... 362/100
2005/0201076 A1 * 9/2005 Marcelle et al. ..... 362/23

* cited by examiner

*Primary Examiner*—Sandra O'Shea
*Assistant Examiner*—Zahra I Bennett
(74) *Attorney, Agent, or Firm*—Rosenberg, Klein & Lee

(57) ABSTRACT

A lock includes a main body, a shining device, and a switch; the main body has a holding portion on one side thereof, which is formed with a through hole; the shining device is held in the holding portion of the main body, and it includes a power source, and a light emitting element; the light emitting element is held in the through hole of the holding portion of the main body such that light emitted from it will travel outside the main body; the switch is connected to the shining device for turning on/off the power for the light emitting element.

3 Claims, 3 Drawing Sheets

SHINING LOCK STRUCTURE

BACKGROUND OF THE INVENTION

1. Field of the Invention

The present invention relates to a shining lock, which will shine for allowing the users to see clearly while unlocking it in the dark.

2. Brief Description of the Prior Art

Using locks can prevent thievery, and make people feel secure. Various kinds of locks are available that serve different purposes. There are two major kinds of locks, key-operated ones and combination locks. And, many improvements have been made on locks to make it difficult for unauthorized persons to unlock the locks. No matter which kind of lock is used, there have to be enough lighting provided to the user in unlocking, otherwise it will be difficult for the user to find the keyhole of a key-operated lock/the numbers of the buttons of a combination lock.

SUMMARY OF THE INVENTION

It is a main object of the invention to provide a shining lock to overcome the above-mentioned problem. The shining lock of the present invention includes a main body, a shining device, and a switch. The main body has a holding portion on one side thereof, which is formed with a through hole. The shining device is held in the holding portion of the main body, and it includes a power source, and a light emitting element; the light emitting element is held in the through hole of the holding portion such that light emitted from the light emitting element will travel outside the main body. The switch is connected to the shining device for turning on/off the power for the light emitting element. Therefore, after the light emitting element is activated, the user can easily find and clearly see the keyhole (or the numbers of the buttons of a combination lock) in the dark, thus capable of easily unlocking the lock.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
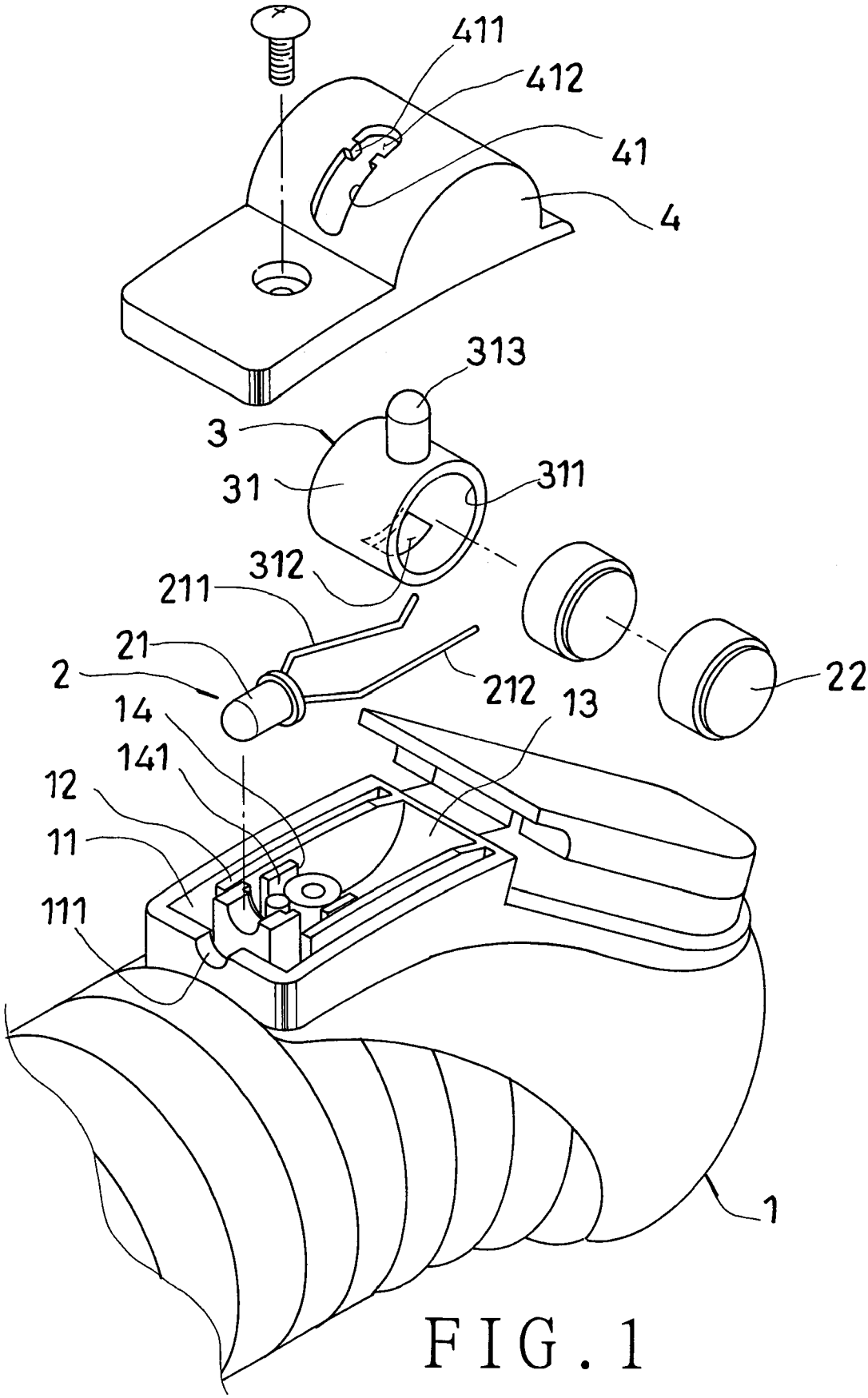
FIG. 1 is an exploded perspective view of the shining lock of the present invention.

Referring to FIG. 1, a preferred embodiment of a shining lock of the present invention, which can be a combination lock or a key-operated one, includes a main body 1, a shining device 2, a switch 3, and a cap 4.

The main body 1 has a holding portion 11 on one side thereof, which has a through hole 111 on one end. The main body 1 has two opposed stopping rib portions 12 in the holding portion 11, a concavely curved slide 13 between the stopping rib portions 12, and a separating part 14 between the through hole 111 and the concavely curved slide 13 in the holding portion 11; two passages 141 form in the holding portion 11 owing to the existence of the separating part 14.

The shining device 2 includes a light emitting element 21, and a power source 22. The light emitting element 21 has two legs 211 and 212, and it is held in the through hole 111 of the holding portion 11 of the main body 1 with the legs 211 and 212 projecting onto the concavely curved slide 13 through the passages 141 respectively.

The switch 3 includes a hollow cylindrical housing part 31, and a pushing rod part 313 projecting from an outer side of the housing part 31. The housing part 31 has a holding room 311, and a gap 312 facing in the opposite direction from that of the pushing rod part 313. The housing part 31 is positioned on the concavely curved slide 13 with a curved side thereof closely touching a portion of the concavely curved slide 13, and with the pushing rod part 313 projecting outwards from the holding portion 11; thus, the switch 3 can be pivoted relative to the concavely curved slide 13 by means of pushing the pushing rod part 313.

The power source 22 of the shining device 2 is held in the holding room 311 of the hollow cylindrical housing part 31. The leg 211 of the light emitting element 21 normally projects into the holding room 311 through the gap 312, and touches a first electrode of the power sources 22 while the leg 212 of the light emitting element 21 constantly touches the other electrode of the power source 22.

The cap 4 has a slot 41, and two opposed protrusions 411, which are formed next to an edge of the slot 41 to divide the slot 41 into two sections including a detaining section 412, and a second section. The cap 4 is secured over the holding portion 11 of the main body 1 with the pushing rod part 313 of the switch 3 projecting outwards through the slot 41.

Figure 2:
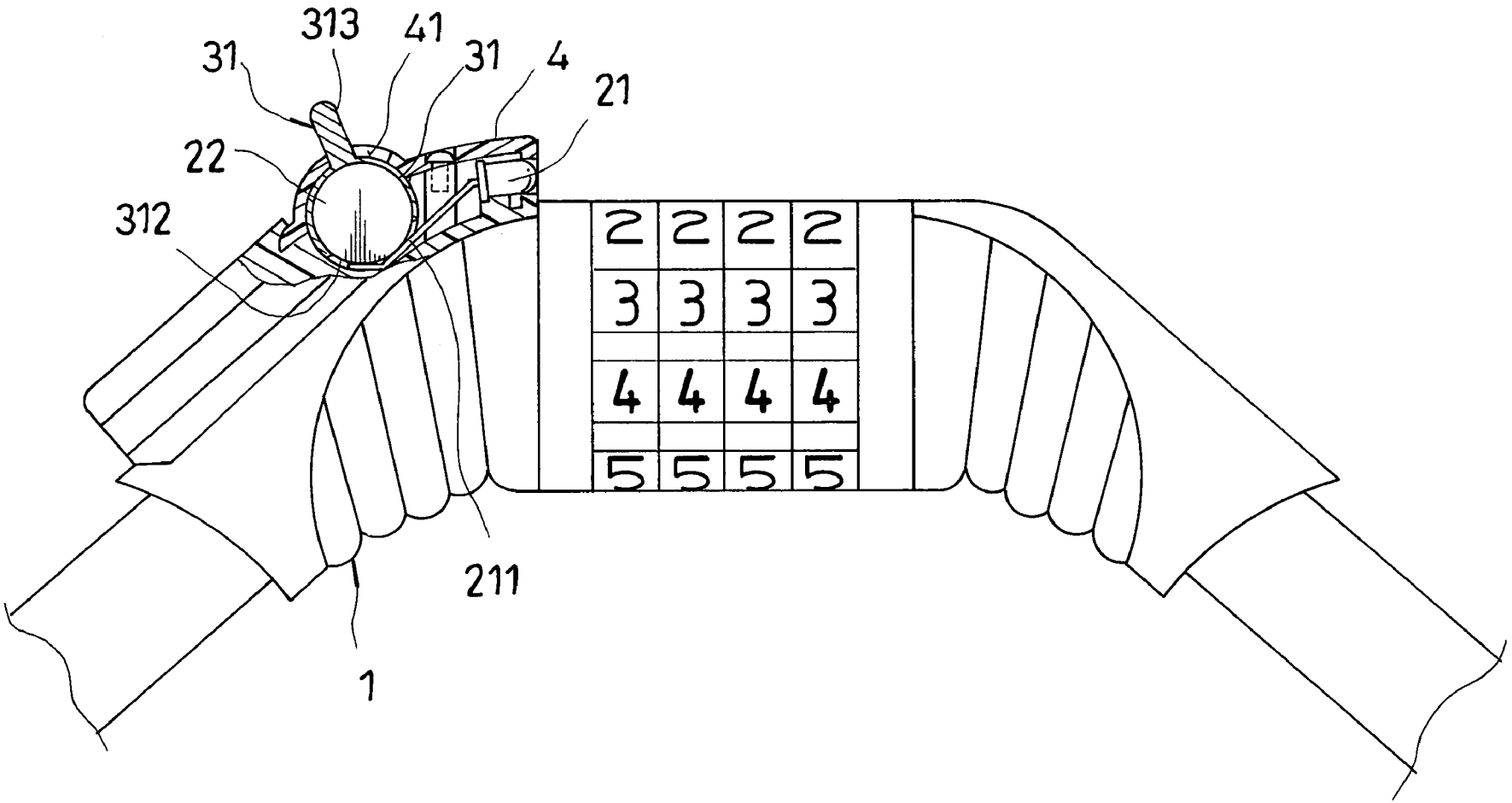
FIG. 2 is a view of the shining lock of the invention in use (1)

Referring to FIGS. 1 and 2, when the pushing rod part 313 of the switch 3 is pushed along the slot 41 of the cap 4 to change the position of the housing part 31 until the pushing rod part 313 is received in the second section of the slot 41, the housing part 31 will press a tail end of the leg 211 of the light emitting element 21 so as to make the leg 211 get out of touch with the first electrode of the power source 22. Consequently, the circuit consisting of the light emitting element 21 and the power source 22 is opened, and the light emitting element 21 won't be activated.

Figure 3:
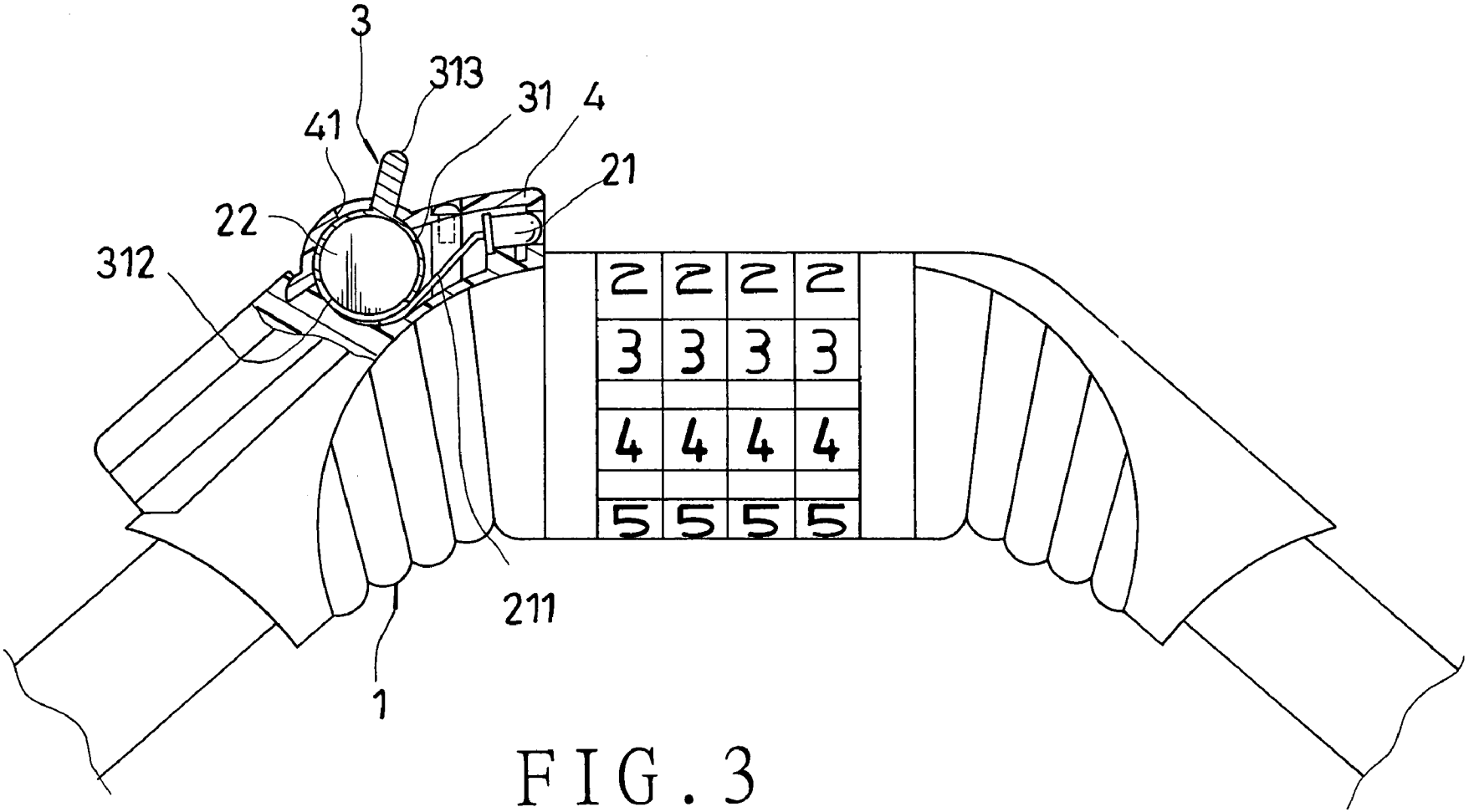
FIG. 3 is a view of the shining lock of the invention in use (2).

Referring to FIGS. 1 and 3, when the pushing rod part 313 of the switch 3 is pushed so as to overcome the stoppage of the opposed protrusions 411 of the cap 4, and move from the second section of the slot 41 into the detaining section 412, the housing part 31 will stop pressing the tail end of the leg 211 of the light emitting element 21, and in turn the leg 211 returns to its original shape to project through the gap 312 of the housing part 31 and get into touch with the first electrode of the power source 22. Consequently, the light emitting element 21 is powered by the power source 22, and starts shining.

Because the lock is equipped with the shining device, the users can easily find and clearly see the keyhole (or the numbers of the buttons of a combination lock) in the dark after the shining device is activated, thus capable of unlocking the lock with ease. Therefore, the shining lock of the present invention is convenient to use. Furthermore, the shining lock of the present invention can also be used as a flashlight after the light emitting element is powered.

What is claimed is:

1. A structure of a shining lock, comprising;

a main body; the main body having a holding portion on one side thereof;

a shining device held in the holding portion of the main body; and a switch connected to the shining device for controlling power from a power source for the shining device;

wherein the holding portion of the main body has a through hole, and the main body has two opposed stopping rib portions formed in the holding portion thereof, a concavely curved slide formed between the stopping rib portions in the holding portion, a separating part between the through hole and the concavely curved slide, and two passages forming in the holding portion owing to existence of the separating part; the switch including a hollow housing part having a holding room.

2. A structure of a shining lock comprising:

a main body; the main body having a holding portion on one side thereof;

a shining device held in the holding portion of the main body; and a switch connected to the shining device for controlling power from a power source for the shining device;

wherein the holding portion of the main body has a through hole, and a cap secured over it, and the main body has two opposed stopping rib portions formed in the holding portion thereof, a concavely curved slide formed between the stopping rib portions in the holding portion, a separating part between the through hole and the concavely curved slide, and two passages forming in the holding portion owing to, existence of the separating part; the cap having a slot; the shining device including a light emitting element; the switch including a hollow housing part, and a pushing rod part projecting from an outer side of the housing part; the housing part of the switch having a holding room, in which the power source is held; the housing part of the switch having a gap facing in an opposite direction from that of the pushing rod part; the housing part being positioned on and pivotal relative to the concavely curved slide with the pushing rod part projecting outwards through the slot of the cap; the light emitting element having first and second legs projecting onto the concavely curved slide through the passages respectively; the first leg of the light emitting element projecting into the holding room of the housing part of the switch through the gap; the second leg touching other electrode of the power source; the housing part of the switch being capable of being pivoted to such a position as to make the first leg get into touch with the first electrode by means of pushing the pushing rod part along the slot of the cap; the housing part of the switch being capable of being pivoted to such a position as to make the first leg get out of touch with the first electrode by means of pushing the pushing rod part along the slot of the cap.

3. The shining lock structure as claimed in claim 2, wherein the cap has two opposed protrusions, which are formed next to an edge of the slot to divide the slot into two sections including a detaining section, and which will limit movement of the pushing rod part of the switch after the pushing rod part is moved into the detaining section of the slot.

* * * * *